United States Patent [19]

Bivens

[11] Patent Number: 4,858,257

[45] Date of Patent: Aug. 22, 1989

[54] BODY BRUSH AND SHOWER STALL SYSTEM

[76] Inventor: David J. Bivens, 304 Clover La., Danville, Va. 24541

[21] Appl. No.: 166,348

[22] Filed: Mar. 10, 1988

[51] Int. Cl.[4] ..... A47K 7/04; A47K 7/02

[52] U.S. Cl. ..... 4/606; 4/596; 4/597; 15/21 D; 128/56; 128/65

[58] Field of Search ..... 4/606, 596, 597; 15/21 D, 21 E, DIG. 5, DIG. 2, 21, 75, 71, 57, 53 AB; 128/56, 44, 57, 58

[56] References Cited

U.S. PATENT DOCUMENTS

| | | | |
|---|---|---|---|
| 1,680,989 | 8/1928 | Hibner | 128/56 |
| 1,723,410 | 8/1929 | Dickert | 4/596 X |
| 1,765,444 | 6/1930 | Phillip | 15/74 |
| 2,068,757 | 1/1937 | Mishelle | 4/606 |
| 2,221,442 | 11/1940 | Cunningham | 15/74 |
| 2,589,281 | 3/1952 | Ocana | 4/597 X |
| 2,657,685 | 11/1953 | Holland | 4/606 |
| 2,876,765 | 3/1959 | Day | 15/21 DX |
| 2,896,857 | 7/1959 | Tompkins | 239/751 |
| 3,091,776 | 3/1962 | Roberts | 4/606 |
| 3,196,867 | 7/1965 | Perry | 128/56 |
| 3,231,200 | 1/1966 | Heald | 4/596 X |
| 3,332,098 | 7/1967 | Smith | 15/53 AB |
| 3,862,459 | 1/1975 | Brunette | 15/21 D |
| 3,921,242 | 11/1975 | Clark | 15/DIG. 2 |
| 4,008,503 | 2/1977 | Tharp | 15/21 D |
| 4,028,766 | 6/1977 | Bivens | 15/53 AB |
| 4,061,136 | 12/1977 | Vaniglia | 128/56 X |
| 4,115,891 | 9/1978 | Wills | 15/71 |
| 4,356,583 | 11/1982 | Wallasch et al. | 15/21 E |
| 4,417,362 | 11/1983 | Walker | 4/606 |
| 4,432,105 | 2/1984 | Pitroda | 4/597 X |
| 4,463,462 | 8/1984 | Greenhut | 4/597 X |
| 4,733,421 | 3/1988 | Kuersteiner | 4/606 X |

FOREIGN PATENT DOCUMENTS 2843683 4/1980 Fed. Rep. of Germany ..... 15/21 D

OTHER PUBLICATIONS

"Silver Brush 1100", Seamster Fabrication Inc., Pamphlet.

*Primary Examiner*—Henry J. Recla
*Assistant Examiner*—Daniel Stein-Freer
*Attorney, Agent, or Firm*—Jim Zegeer

[57] ABSTRACT

A boby brush shower stall in which a body brush is vertically oriented and supported from a single bearing, and driven through a clutch mechanism from a gear box and electrical motor at a speed range greater than about 90 rpm and below about 120 rpm. The body brush is mounted on the vertical drive shaft and has soft flexible bristles which hang and droop downwardly at speeds below 90 rpm and which extends substantially horizontally when rotated at speeds above 90 rpm and a spray bar sprays liquid on the elongated body brush at spaced points along the length thereof to maintain the lubricity of the bristles at a certain level. The bristles are soft and flexible and conform to body contours to provide the unique massage, clean and scrubbing action to cleanse the skin surfaces of dirt, scale and provide a certain invigorating action. A stall is provided having a pair of end walls, back walls and short front side walls, the short front side walls defining an entranceway upon which a door is hung and a three-sided chamber for the body brush and a seat section for a bather spaced from the body brush a distance short enough that a bather can sit on the seat and place his or her feet into the rotating brush. A venturi system is utilized for injecting various soaps, body lotions, body oils or rinse additives to the water sprayed on the body brush to maintain the lubricity thereof.

17 Claims, 4 Drawing Sheets

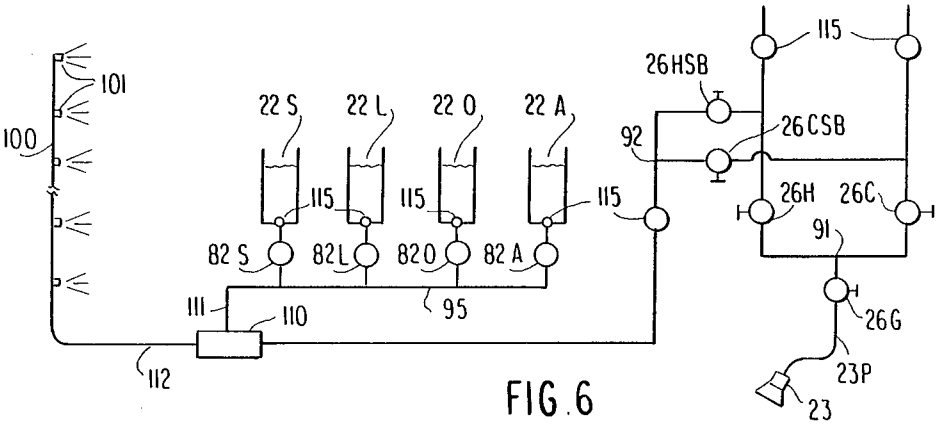
FIG. 6
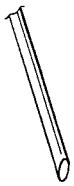
FIG. 7b
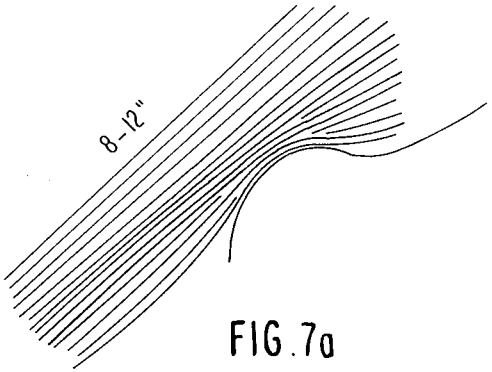
FIG. 7a
FIG. 3
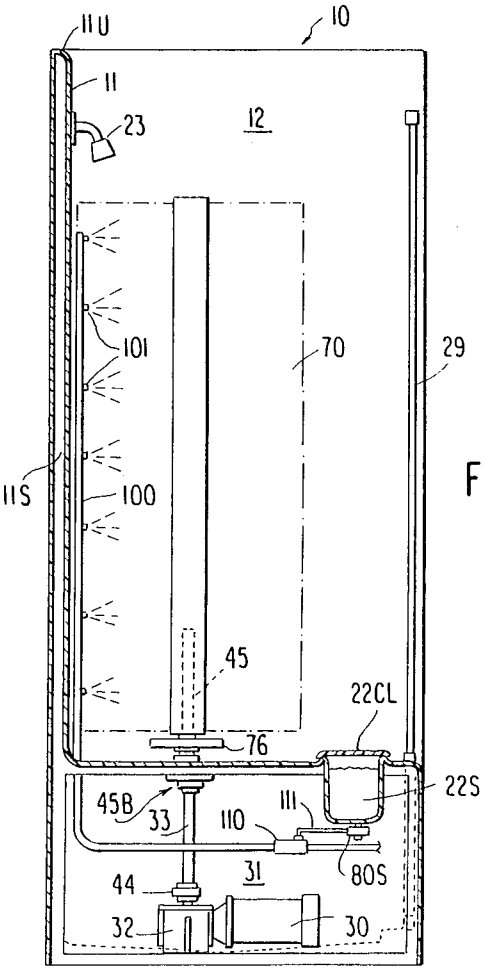

BODY BRUSH AND SHOWER STALL SYSTEM

BACKGROUND AND BRIEF DESCRIPTION OF THE INVENTION

Prior Art Statement

Body brushes incorporated in shower stalls have been known for many, many years. Roberts U.S. Pat. No. 3,091,776, for example, discloses a rotary shower brush in which a pair of brushes are driven through a pair of clutches and in which a soap or other liquid additive is pumped in a mixer of water to the brush. There, relatively small diameter brushes were rotated at speeds in range of 25 to 500 rpm. In Tharp U.S. Pat. No. 4,008,503, the brush used a spiral ring of stiff bristles for massaging purposes and the entire assembly was mounted on a rack and frame for adjusting the height thereof. In Brunette U.S. Pat. No. 3,862,459, a scrubber and massager apparatus is disclosed in which the unit could be adapted to a shower stall or bathing enclosure. In Walker U.S. Pat. No. 4,417,362, the device was a completely stationary unit which the user provided the action or movement against the brushes or bristles and a sponge for washing or cleaning inaccessible parts of the body. In Holland U.S. Pat. No. 2,657,685, the mechanical body massager had a plurality of flaps or slapping elements made from rubber or the like which slapped and massaged the body as the shaft rotated. In Perry U.S. Pat. No. 3,196,867, a plurality of brushes were provided in a body massaging and scrubbing appliance in which a gear train was utilized to rotate the adjacent brushes in different rotary directions so that adjacent brushes would be rotated in unison but have their cylindrical surfaces moving away from each other so as to contact the back of the person and tend to spread the skin of the person along an elongated area while the brushes were rotating while adjacent brushes were rotated towards each other so as to tend to draw the skin together along a line. Finally, in Mishelle U.S. Pat. No. 2,068,757, a turbine drive driven by water coming into the shower is used to drive the rotary brush.

These prior art body brush-type systems require spaced pairs of mounting bearings for the brush making it difficult to change or service the brush, and they generally use relatively stiff bristle brushes, e.g., bristles which are relatively horizontal when the brush is stationary. Moreover, these apparently have not found any commercial success.

The object of the present invention is to provide an improved body brush and shower stall which is simple, reliable, and provides superior performance at reasonable low cost.

According to the present invention, a body brush is mounted on a vertical drive shaft having a single bearing for rotatably supporting the brush at its lower end with the weight of the brush serving to provide the friction loading necessary on a unique built-in fail-safe clutch mechanism which is driven from a gear box which, in turn, is driven by an electric motor. The gear box is designed so as to drive the brush at a rotary speed of from about 90 rpm to about 120 rpm. In this preferred embodiment, the body brush has relatively soft flexible bristles which hang and droop downwardly at speeds below 90 rpm but which extend substantially horizontally when rotated at speeds above about 90 rpm. In the present embodiment, the bristles may be about 12 inches long and reach a substantially horizontally extended position when the brush is rotated at about 100 rpm. Brushes of the type used in automatic car wash systems are highly suitable for use in this invention. A vertical spray bar is provided to spray, at all times that the brush is rotating, a lubricating medium such as water, but preferably water in a mixture with one or more of a liquid soap, body lotion, body oil, or a rinse additive which may be selectively controlled by low voltage solenoids and injected through a venturi injection system into mixture with the water. One or more check valves prevent any of the additives from being drawn back or fed back into the water supply.

In the preferred embodiment, the brush drive includes a unique clutch construction which, in a preferred embodiment, depends upon the weight of the brush assembly to provide sufficient loading force on a friction clutch disk to rotate the brush and includes a shaft portion projecting into the interior of the brush roller to assure stability and verticality of the brush when the body or a portion of the user bears or presses against the brush bristles. The drive shaft for the clutch mechanism is electrically insulated from the gear box assembly by a Teflon TM insulating coupling. A pair of sprockets are provided, one of which is secured by a taper-lock bushing to the lower end of the brush drive shaft and the other of which is secured by a similar taper-lock bushing to the upper end of the drive shaft from the gear box. A Teflon TM chain engages both sprockets to couple the sprockets and insulate the brush mounting structure from the gear box and motor shafts. A flat disk nylon washer is positioned between the ends of the two shafts to make certain that the two shafts do not ever make electrical contact. Furthermore, the electrical drive motor is of the type which has been insulated to assure safe operation in this particular environment.

A shower stall incorporating the invention is provided with an elongated back wall and two end walls and a pair of short front walls which provide an entranceway with the outer vertical edges of the two front walls being integrally molded to the vertical edges of the two end walls and, with the back wall, form two-three wall chambers (1) a brush chamber for the rotary brush to thereby reduce the tendency of water and other fluids from being thrown outwardly by centrifugal force toward the entranceway and (2) a seat chamber for the bather to sit and place his or her feet in the brush for massaging, cleaning, etc. purposes, as well as to sit while bathing in the shower.

Thus, the invention provides a body brush apparatus and shower stall which is simple, reliable and provides superior performance over the prior art.

DESCRIPTION OF THE DRAWINGS

The above and other objects, advantages and features of the invention will be clear to those skilled in the art from the following detailed description taken in conjunction with the accompanying drawings wherein:

FIG. 3 is an end view with one of the end walls removed, FIG. 6 is a fluid circuit schematic illustrating the various water and liquid soap, body lotion, body oil and rinse additions reservoirs and their interrelationships, and FIG. 7*a* is a diagrammatic illustration of how the long, soft, flexible bristles adapt to and conform to body concavities and convexities to provide more effective cleaning, massaging and scrubbing and FIG. 7*b* is an illustration of a bristle fiber having smoothly rounded edges.

DETAILED DESCRIPTION OF THE INVENTION

Figure 1:
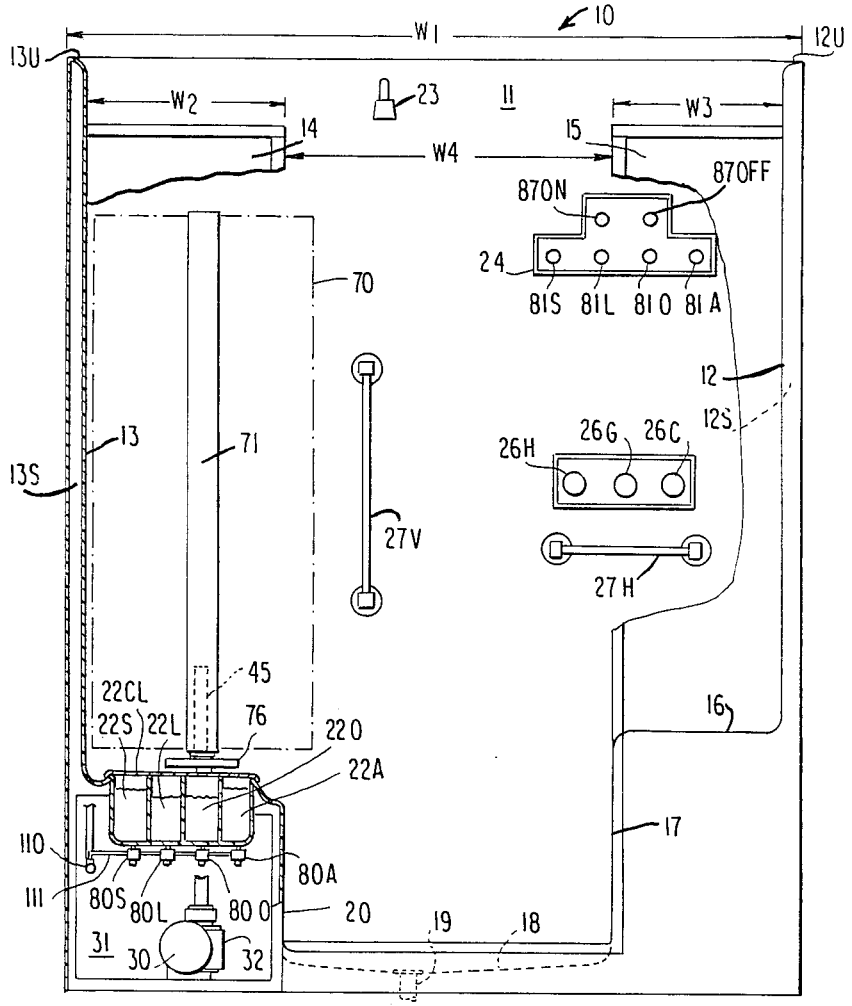
FIG. 1 is a front plan view with portions stripped away to expose the interior of a body brush apparatus and shower stall incorporating the invention.
Figure 2:
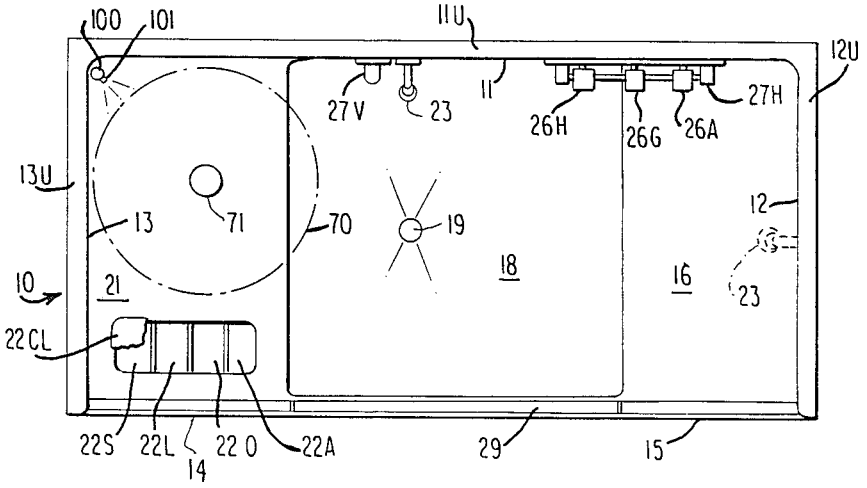
FIG. 2 is a top plan view of the body brush and shower stall apparatus shown in FIG. 1.

Referring collectively to FIGS. 1–3, a shower stall 10 which, in this preferred embodiment, is molded of fiberglass includes a back wall 11, two lateral end walls 12 and 13, and two relatively short front walls 14 and 15, with the back wall 11 being molded to be integrally joined to the vertical edges of the two end walls 12 and 13, respectively, and the two short front walls 14 and 15 being molded and integrally joined at their outer vertical edges to the outer vertical edges of the end walls 12 and 13, respectively. In addition, a seat 16 is integrally molded as part of the back wall portion 15 and the seat has a downwardly depending front wall 17 which joins integrally with a floor 18 having a drain 19 with floor 18 shaped and sloped so as to direct fluid flow to the drain 19. The seat 16 generally slopes toward wall 12 for comfort, but is provided with drain grooves (not shown) which slope toward wall 17 and allow water and other liquids to flow to floor drain 19 and avoid puddles. The right end of floor 18 is integrally joined to a vertical wall 20 which, in turn, is integrally joined to a brush bearing wall 21 which has a very slight slope toward floor 18 for drainage purposes, but is essentially horizontal. Each of said walls 11, 12 and 13 has an upper curved edge 11U, 12U and 13U, respectively, which curves outwardly from the interior space to form a small space 11S, 12S and 13S, respectively, about $1\frac{1}{2}$ inches deep to run piping, insulated electrical wires and provide space for various valves, solenoids, etc.

Liquid soap, body lotion, body oil and rinse additive chambers 22S, 22L, 22O, and 22A may be integrally formed or added as a separate adjuncts to the brush bearing wall 21. A conventional shower head 23 is mounted in wall 12 and low voltage electrical control panel 24 is mounted in an upper level of the rear wall 11. Conventional hot and cold water faucet handles 26H and 26C are mounted at a convenient location on rear wall 11 which may also include safety handles 27V and 27H, respectively. A further valve 26G may be provided to control water flow to shower head 23 which permits the bather to optionally shut the water off from the shower head 23 while using the body brush. The shower head may optionally be mounted in any of the other walls, such as wall 12 and the bather can sit directly under the shower spray from head 23. In this embodiment of the shower stall, the dimensions given are exemplary but it should be noted in particular that the short front walls 14 and 15 have widths which are a fraction of the width of rear wall 11 with short front wall 14 having a width $W_2$ and short front wall 15 having a width $W_3$ to form a three-walled brush chamber and a three-walled seat chamber. The spacing between the two short front walls 14 and 15 defining an entranceway width $\omega_4$ to the shower stall which is provided with a conventional shower door 29 which, in turn, may be pivoted on either short wall (as in this case), or sliding.

SINGLE BRUSH BEARING AND CLUTCH DRIVE ASSEMBLY

As shown in FIGS. 1 and 3, the space below horizontal wall 21 constitutes a motor drive chamber 31 for an electrical drive motor 30 which may be a one-half horsepower single-phase motor and a gear reducer 32 which, in this preferred embodiment is a 15/1 ratio gear reducer. In this case, if the motor 30 operates at about 1740 rpm, the gear box 32 which is direct coupled to the motor 30 will reduce this to about 116 rpm. So that the output drive shaft 33 rotates at about 115–116 rpm.

Figure 4:
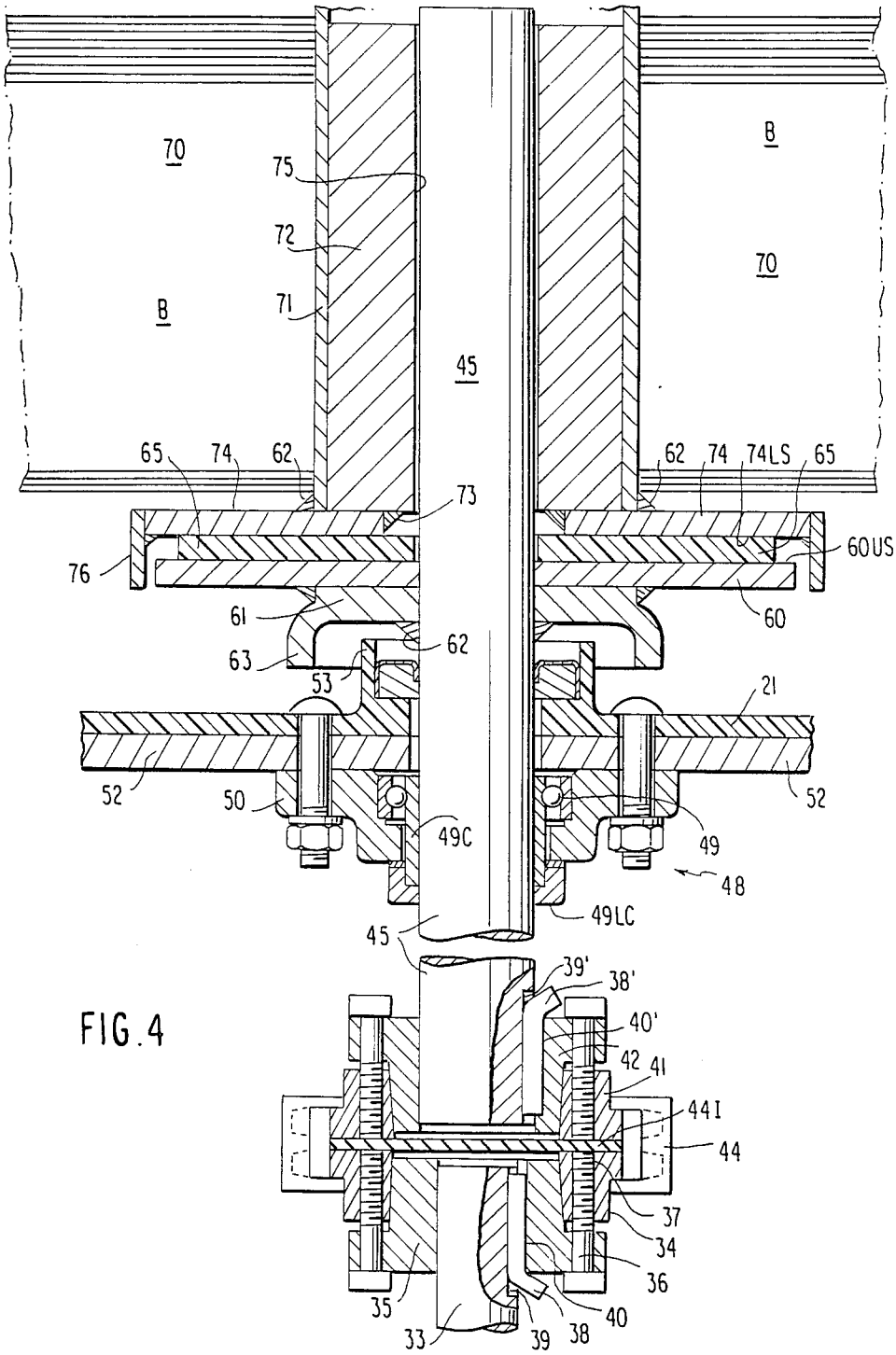
FIG. 4 is a sectional view of the clutch and brush mounting assembly and single bearing mount passing through the inner shower surface.

Referring now to FIG. 4, the gear box drive shaft 33 has mounted on the end thereof a sprocket 34 which is secured thereto by a taper lock bushing 35 which includes bolts 36 which threadably engage with bore holes 37 in the sprocket 34 and are keyed by a spline 38 which engages in groove 39 in shaft 33 and a corresponding groove 40 in taper lock bushing 35. A similar sprocket and taper lock bushing unit 41 and 42, respectively, are secured to the lower end of a drive shaft 45 and a Teflon TM insulating coupling 44 is meshed with the teeth on the two sprockets to insulatingly couple shafts 33 and 45 for driving engagement. An insulated disc 44I assures that there is no conductive contact between the ends of the two shafts 33 and 45. In this preferred embodiment shaft 45 is a solid corrosion resistant steel drive shaft having a diameter of $1\frac{1}{4}$ inches. Drive shaft 45 is journaled for rotation in a single standard flange bearing assembly 48 which includes a ball bearing raceway 49 and a flange cup 50 which is bolted to the wall 21 and includes a stiffening plate 52 to provide a high degree of rigidity to the fiberglass wall structure 21. The bearing raceway includes a short collar member 49C for engagement with the short drive shaft 45. At the same time, an upwardly projecting annular flange 53 molded into wall 21 assures that water or other liquids flowing on the inner shower wall surface 21 to the drain 19 does not overflow into the bearing assembly. It will be appreciated that conventional water seal units may be incorporated but the high annular flange wall 53 is adequate to prevent fluid flow into the bearing thereby assuring long bearing life for these permanently lubricated bearings.

The short drive shaft has secured thereto a steel clutch disk 60 which is welded to an annular cup plate 61 which, in turn, is welded to drive shaft 45 as indicated at 62. It should be noted that the cup plate 61 may include a downwardly depending skirt 63 which, in junction with upwardly projecting annular flange 53 provides a high degree of protection to the joint from water getting into the bearing assemblies.

A clutch disk plate 65, which is made of a Nylatron friction material, is secured to the upper surface 60US of the steel clutch disk 60. The brush 70 includes a brush roller 71 to which all of the bristles B are secured in conventional fashion. Brush roller 71 includes an inner cylinder 72 which is secured thereto by welds 62 and a flat clutch disk member 74 likewise welded by welds 73 to brush roller 71 and internal cylinder 72. Internal cylinder 72 has an internal diameter or bore 75 which is just slightly larger than the $1\frac{1}{4}$ inch diameter of the drive shaft 45 so that the drive shaft projects upwardly therein so that the brush 70 is simply set upon the upper projecting end of drive shaft 45 and the weight of the brush, brush roller 70 and internal hollow rod 72 provide the forces sufficient to cause the frictional driving of the brush upon rotation of the clutch disk 60 and clutch material 65.

It will be appreciated that the clutch disk 65 can be secured to either the clutch disk 74 or clutch disk 60. An annular depending guard rim 76 is secured to clutch disk 74 by welding and depends sufficiently downwardly so as to assure that no water reaches the clutch plate and it also keeps the drooping brush bristles from entering into this clutch assembly.

Thus, the drive shaft and clutch assembly shown in FIG. 4 provides a simple clutching arrangement which assures a high degree of safety in preventing injury to a user because the brush bristles B being soft and flexible and only extending outwardly upon rotation above a certain speed (in the preferred embodiment, at a speed of about 100 rpm the bristles B are horizontal) to engage the body or portions of the body of the user stop rotating because of the declutching action when any significant loading greater than the brush bristles engaging the user's body is applied to the brush. If the bather pushes too hard with the body or a portion thereof, there is an instantaneous fail-safe declutching action and as soon as the load is removed, the brush is again rotated. At the same time, the Teflon TM insulating coupling and the flat disk nylon washer assures that the steel shafts 45 and 33 can never make electrical contact to thereby insulate the brush and its mounting structure from the gear box and motor so that in the event of some electrical accident such as a shorting of the electrical motor or the internal components thereof or wiring thereto to some of the metal parts there is no danger of electrical shock transmitted to the brush and its mounting structure. It will be appreciated that shaft 45 may be made of a non-conductive material or have a non-conductive coating thereon.

SOAP, BODY LOTION, BODY OIL AND OTHER RESERVOIRS

Figure 5:
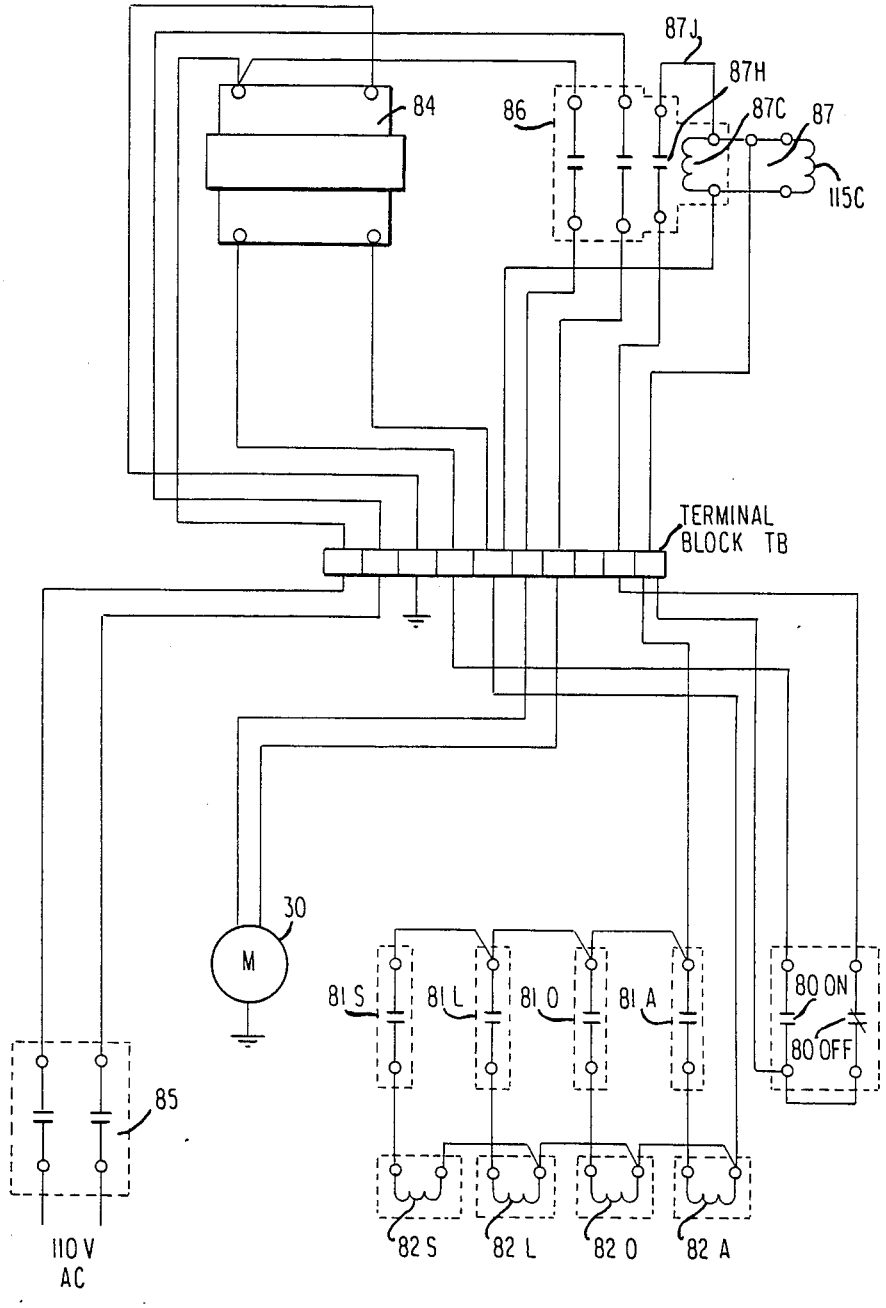
FIG. 5 is a schematic of the electrical control circuit incorporated in the invention.

As discussed above, a group of reservoirs 22S, 22L, 22A and 22O, are provided (it being appreciated that not all the present reservoirs need to be provided) and are formed in or otherwise secured to the wall 21 and are provided with a cover or lid 22CL which may be hingedly attached to the wall 21 to permit easy access to the reservoirs for filling, cleaning, etc. At the bottom of each reservoir is an outlet with an electrically controlled valve 82S, 82L, 82O, and 82A which are low voltage solenoids shown in FIGS. 5 and 6 and have a control or selector switches 81S, 81L, 81O and 81A which control various solenoids 82S, 82L, 82O, and 82A which are connected in electrical circuit with a low voltage from a low voltage (about 24 volts or less) step down transformer 84, the primary of which is connected to 110 volt supply through a protective breaker switch 85. The breaker switch is also connected to the motor starter contactors 86 which, in turn, are controlled by a motor starter relay 87. Motor starter relay 87 has a low voltage relay coil 87C which is connected in circuit with a pair of brush control selector switches 87ON and 87OFF. In this embodiment, when the switch 87ON is turned on, the circuit is completed through relay coil 87C to the low voltage supply from the low voltage side of step-down transformer 84 and upon energization of the coil 87C, a hold-in contact 87H is closed and via jumper 87J maintains the contact relay energized. When the brush control switch 87OFF is actuated, it opens the circuit to the relay coil 87 thereby opening the relay and opening the hold-in contact 87H. A terminal block TB provides a common location for various circuit connections.

THE FLUID FLOW CIRCUIT

Referring now to FIG. 6, a plumbing diagram is illustrated in which the flow of hot water is initiated by a control valve 26H and cold water is initiated by a cold water valve 26C. It will be appreciated that various kinds of these valves are well known in the art and need not be disclosed in detail. The water flows to a common T-joint 91 and through a short section of pipe 23P to the shower head 23 in the usual manner. A valve 23G may be provided as discussed earlier herein. A separate T 92 is provided so as to provide a flowing mixture of hot and cold water at any desired temperature set by valves 26HSB and 26CB (and it will be appreciated that a separate flow path of hot and cold water may be provided to assure a different temperature of water flowing to the additive portion of the system). In other words, the two valves 26H and 26C may be augmented by additional valves 26HSB and 26CSB to adjust the temperature of water flowing to the spray bar 100.

THE SPRAY BAR

As shown in FIGS. 2 and 3, vertical spray bar 100 is located in a corner of the stall and has a plurality of nozzles 101 which spray either clear water or a mixture of soap, lotion, body oil, or rinse lotion or a combination of any of these, mixed with the water and sprayed onto the brush 70 as it rotates. The brush 70 therefore has a minimum level of lubricity due to the spraying thereon of water and/or water and a mixture of other liquids from the spray bar 100. Nozzles 101 are dispersed uniformly along the length of the spray bar to assure uniform lubricity along the entire length of the body brush 70. Selection of any one or more of the fluids in each of the reservoirs 22S, 22L, 22O or 22A by selection of one of selection switches 81S, 81L, 81O or 81A opens the valve 82S, 80L, 80O, or 80A, respectively, thereby making a fluid connection to a common pipe 95 leading to the input side of a venturi injector valve 110. Venturi injector valve 110 has a venturi therein which is actuated by the water flow therethrough to create a suction in section line 111 which, in turn, is connected to common line 95. Thus, flow of the water whether cold water or a mixture of hot and cold water or just plain hot water will induce a suction in suction line 111 thereby drawing fluid from one or more of the reservoirs 22S, 22L, 22O and/or 22A, depending on which of the solenoids 82S, 82L, 82O or 82A have been energized. The venturi provides a good mixing of the fluid drawn from the reservoir with the water flowing in the spray bar line 112 to the spray bar 100. Check valves 115 are conventional and are required by most jurisdictions where some constituent is added to a water line, for example.

Each of the reservoirs 22S, 22L, 22O and 22A has a short tube or pipe dipping into the liquid contents thereof with a combination check valve and strainer 115 at the bottom end thereof.

THE BRUSH

The brush mounting assembly has been described earlier herein and the present section deals with the brush and its bristles per se. One of the features of this invention is that the brush 70 is comprised of soft flexible smooth rounded bristles B (FIG. 7*b*) which may be round or oval which hang and droop downwardly at speeds below about 90 rpm and which extend substantially horizontally when rotated at speeds above about 90 rpm and in this application, nylon brush bristles typically of the type utilized in car cleaning operations have been quite satisfactory for this operation and extend fully horizontally at about 100 rpm and provide safe and effective massage and cleaning of soft body skin and tissues. These bristles provide an important benefit to body massage and cleaning because they improve blood circulation, skin tone and remove scale and loose flaky materials from the skin structure in a gentle way and without any damage to the skin. Thus, instead of stiff bristles, the preferred embodiment of the invention uses long soft bristles which tend to shape their ends to conform more to the body concavities and convexities (FIG. 7*a*) than stiff bristles. This assures that there is more contact with larger body surface areas than with the stiffer bristles and, at the same time, the preferred speed range of under 120 rpm assures that there is no slapping or "whip-like" actions of the bristle strands against the body which would tend to sting and thus possibly injure a user. Moreover, the bristles, when provided with the lubricating effect of the liquid sprayed from the spray bar 100, have a level of lubricity which assures a more uniform and healthful action of the bristles on the user's skin and without any harmful effects of the bristles causing burns and the like. Thus, a preferred feature of the invention is that the fluid to the spray bar is on at all times that the body brush is rotating. This function is performed by providing a 24 volt solenoid 87SB in parallel with brush motor starter relay 115C to open solenoid valve 115 (FIG. 6) whenever brush motor 30 is energized. This assures a certain predetermined level of lubricity with the minimum level of lubricity being determined by the spray of pure water onto the long flexible bristles of the brush 70.

In a preferred embodiment, the bristles of the brush are about 12 inches long and are rotated at about 115–116 rpm with a continual flow of spray of water thereon (hot or cold water) and with the selection of one or more additives such as soap, oil, lotion or a rinse or other body treating liquids.

An important feature of the invention is that the bearing mounting the brush is a single sealed vertical bearing and a single projecting internal vertical stabilizing bar. In addition, the clutch drive is a simple structure and in the preferred embodiment, depends primarily on the weight of the body brush itself to generate sufficient friction in the clutch members to assure a driving of the body brush at the requisite velocity but, at the same time, should the user bear too strongly into the body brush, a quick easy, fail safe termination of drive to the body brush is assured. Moreover, instead of driving a plurality of brushes as in some of the prior art discussed above, a single body brush with large long bristles as described herein, provides an excellent body action which molds and shapes itself to the body contours including convexities as well as concavities thereby reaching places which stiff bristles are unable to reach or which are too rough and too vigorous on the skin.

The short section of the drive shaft 45 projecting into the inner bore 75 of the brush roller provides a high degree of stability and good verticality for the brush. At the same time, the brush can be easily removed from the clutch assembly so that brushes with different qualities to produce different effects in toning up the skin or massaging the body muscles, can easily and quickly be substituted for the preferred brush as described above. Moreover, the forward edge seat unit 16 in the seat chamber is spaced from the body brush such that an average sized bather can comfortably clean and massage the soles of the feet and ankle and legs as well. For the face and neck, the upper bristles on the brush may be made softer, if desired.

While I have shown and described a preferred embodiment of my invention, it will be appreciated that various modifications, adaptations and changes can be incorporated into the invention without departing from the spirit and scope thereof which is defined in the appended claims and it is intended to encompass such modification, adaptations within the spirit and scope of the claims appended hereto:

What is claimed is:

1. Body brush apparatus comprising, in combination, a vertical drive shaft having upper and lower ends and a single bearing rotatably supporting said vertical drive shaft near its lower end in a substantially upwardly vertical position and a substantially horizontal wall surface supporting said single bearing, an electrical drive motor, means which electrically insulatingly couple said electrical drive motor to said vertical drive shaft, means controlling the operation of said electrical drive motor so that said vertical drive shaft rotates at a predetermined speed in the speed range of greater than about 90 rpm to below about 120 rpm, a single elongated body brush removably mounted coaxially over said upper end of said vertical drive shaft and having long soft flexible bristles which hang and droop downwardly at speeds below 90 rpm and which extend substantially horizontally when rotated at speeds above said about 90 rpm, and tend to shape their ends to conform to human body concavities and convexities, vertical spray bar means for spraying a liquid on said elongated body brush at spaced points along the length thereof.

2. Body brush apparatus as defined in claim 1, wherein said motor is located below said horizontal wall, said means for insulatingly coupling said electrical drive motor to said vertical drive shaft including a reducing gear box having a second vertical drive shaft directly driven from said reducing gear box and electrically non-conductive flexible coupling means coupling said second vertical drive shaft to the first said vertical drive shaft to drive said first vertical shaft in said speed range.

3. Body brush apparatus as defined in claim 1, wherein said long soft flexible bristles are about 12 inches long, have smooth rounded external surfaces and extend fully horizontally when rotated at about 100 rpm.

4. Body brush apparatus as defined in claim 3 wherein said body brush is rotated at about 115–116 rpm.

5. A bathing facility comprising, in combination, the body brush apparatus as defined in claim 1 wherein said horizontal wall surface is a part of said bathing facility and said motor is located below said horizontal wall surface, and further including a seat surface on an opposite side of said bathing facility from said horizontal wall surface, means supporting said seat surface a predetermined distance from said body brush so that a bather, seated on said seat, can comfortably insert and remove his or her feet into the path of said long soft flexible bristles of said body brush.

6. Body brush apparatus as defined in claim 1, including a supply of water for said spray bar means, and a selectable supply means of one or more further liquids, venturi injector/metering means coupled to said supply of water, solenoid controlled valve means connecting said selectable supply means of one or more further liquids to said venturi injector/metering means to provide a mixture water and a metered amount of said one or more further liquids to said spray bar means.

7. A bathing facility comprising, in combination, the body brush apparatus as defined in claim 1 wherein said horizontal wall surface is a part of said bathing facility, said bathing facility further including a stall wall portion surrounding said elongated body brush on at least three sides and joined to said horizontal wall surface on said three sides, and said body brush being spaced from and rotated in a direction to prevent liquid being thrown out of said stall by centrifugal forces.

8. A bathing facility comprising, in combination, the body brush apparatus as defined in claim 1, said bathing facility further including, a stall, said stall having:

a pair of end walls, a back wall of a length ($\omega_1$) and a pair of short front walls of a length ($\omega_2$) and ($\omega_3$), respectively, with $\omega_2+\omega_3$ being less than length $\omega_1$ to provide a stall entranceway having a width ($\omega_4$), the one of said short walls of a length ($\omega_2$) being joined at one vertical edge thereof to one vertical edge of one of said end walls, with the other vertical edge being joined to a vertical edge of said back wall to form a body brush chamber in which said body brush is positioned, said horizontal wall being joined to said backwall, said one of said end walls and said one of said short walls of a length ($\omega_2$), the one of said short walls of a length ($\omega_3$) being joined to one vertical edge of another of said pair of end walls with the other vertical edge of said another of said pair of end walls being joined to a second vertical edge of said back wall to form a second chamber facing said first chamber and a seat joined to said back wall, end wall and short wall of a length ($\omega_3$).

9. Body brush apparatus as defined in claim 1, including means to assure the spray of liquid on said body brush at all times said body brush is rotated at said speed to insure substantial lubricity above a predetermined level of said long soft bristles relative to the skin of a human body.

10. Body brush apparatus as defined in claim 1 wherein said electrical drive motor is positioned below said single bearing, said substantially horizontal wall surface having means integrally formed therewith which form a water sealed enclosure for said electrical drive motor.

11. Body brush apparatus as defined in claim 10 wherein said vertical drive shaft includes a first clutch plate secured thereto a predetermined distance above said single bearing and horizontal mounting surface such that said first clutch plate is below the uppermost end of said vertical drive shaft, said elongated body brush having a lower end and a hollow core, a second clutch plate concentrically secured to the lower end of said body brush and having a central aperture such that said uppermost end of said vertical drive shaft projects therethrough and the weight of said body brush is transmitted to said first clutch plate by said second clutch plate and said body brush is maintained centered on said shaft by the projection of said uppermost end of said vertical drive shaft into said hollow core.

12. Body brush apparatus comprising, in combination, a first vertical drive shaft having upper and lower ends and a single bearing rotatably supporting said first vertical drive shaft near its lower end in a substantially upwardly vertical position, brush support means rigidly attached to said shaft above said bearing, an drive unit having a second vertical drive shaft, means for controlling the operation of said drive unit at a predetermined speed in the speed range of greater than about 90 rpm to below about 120 rpm, said drive unit including an electrical induction motor and a reducer gear box with said second vertical drive shaft being an output shaft from said gear reducer and whereby said second vertical shaft is attached at its upper end to said first vertical shaft, an elongated body brush coaxially freely and removably mounted over said upper end of said first vertical drive shaft thereby resting on said brush support means and having soft flexible bristles, and fail-safe clutch means between said brush support means and said elongated body brush.

13. A bathing facility comprising, in combination, the body brush apparatus as defined in claim 12, and including a three-sided chamber surrounding said body brush forming a brush chamber and a seat chamber facing said brush chamber, and a seat in said seat chamber, said seat being spaced from said brush chamber such that a user while seated can place his or her feet in the paths of said brush.

14. A bathing facility as defined in claim 13, including spray bar means which sprays a liquid on said elongated body brush at spaced points along the length thereof.

15. In a bathing facility having a body brush having a vertically aligned axis, a central core roller, and brush fibers secured to said core roller, the improvement comprising, a substantially horizontal mounting surface, a vertical drive shaft and bearing means for rotatably supporting said vertical drive shaft at its lower end in a substantially vertical position and having an upper end projecting through and above said substantially horizontal mounting surface, whereby said core roller of said body brush is hollow and removably mounted over said upper end of said drive shaft, an electrical drive motor drivingly coupled to said vertical drive shaft below, and shielded by, said substantially horizontal mounting surface, spray means for spraying a liquid on said elongated body brush, and an annular liquid dam on said substantially horizontal wall and surrounding the location where said drive shaft projects through said surface to prevent liquids flowing over said substantially horizontal surface from reaching said location.

16. The bathing facility defined in claim 15, including a first clutch plate secured on said vertical shaft a predetermined distance from the upper end thereof and above said substantially horizontal surface, a second clutch plate secured to said central core roller in opposing face-to-face relation to said first clutch plate, and friction clutch material on one of the facing surfaces of said clutch plates.

17. The bathing facility as defined in claim 16, wherein said central core roller is hollow and receives the upper end of said vertical shaft to stabilize said body brush.

* * * * *